US005245377A

United States Patent [19]

Samuels et al.

[11] Patent Number: 5,245,377

[45] Date of Patent: Sep. 14, 1993

[54] METHOD FOR DETECTING NON-VALID STATES IN FILM PROCESSOR TEMPERATURE CONTROL SYSTEM

[75] Inventors: James T. Samuels, Rochester; Michael Newman, Pittsford, both of N.Y.

[73] Assignee: Eastman Kodak Company, Rochester, N.Y.

[21] Appl. No.: 759,484

[22] Filed: Sep. 13, 1991

Related U.S. Application Data

[63] Continuation-in-part of Ser. No. 738,664, Jul. 31, 1991, which is a continuation-in-part of Ser. No. 495,867, Mar. 19, 1990, Pat. No. 5,065,173, which is a continuation-in-part of Ser. No. 497,647, Mar. 16, 1990, Pat. No. 4,994,837.

[51] Int. Cl.[5] ..... G03D 3/00

[52] U.S. Cl. ..... 354/299; 354/322; 34/31; 34/48

[58] Field of Search ..... 354/299, 322, 324; 34/30, 31, 46, 48, 155

[56] References Cited

U.S. PATENT DOCUMENTS

| | | | |
|---|---|---|---|
| 4,057,817 | 11/1977 | Korb et al. | 354/298 |
| 4,160,153 | 7/1979 | Melander | 354/299 X |
| 4,182,567 | 1/1980 | Laar et al. | 354/299 |
| 4,300,828 | 11/1981 | Kaufmann | 354/322 |
| 4,316,663 | 2/1982 | Fischer | 354/299 |
| 4,332,456 | 6/1982 | Kaufmann | 354/299 X |
| 4,914,835 | 4/1990 | Kose et al. | 354/299 X |
| 4,952,960 | 8/1990 | Kosugi et al. | 354/299 |
| 4,985,720 | 1/1991 | Masuda et al. | 354/299 |
| 4,994,837 | 2/1981 | Samuels et al. | 354/299 |
| 5,065,173 | 11/1991 | Samuels et al. | 354/298 |

OTHER PUBLICATIONS

Kenneth W. Oemcke, "Ambient Water Thermal Control System," Dept. of Mechanical Engineering, Rochester, N.Y., Jul. 1978.

*Primary Examiner*—A. A. Mathews

*Attorney, Agent, or Firm*—Warren Locke Franz

[57] ABSTRACT

A temperature control system (10) of an automatic film processor (12) includes developer and fixer recirculation paths (30, 40) having thermowell heaters (34, 44) and thermistors (35, 45), and a cooling loop (37) in the developer path (30) which passes in heat exchange relationship with water in a wash tank (23). The system (10) also has a blower (48), heater (49) and thermistor (52) in an air path of a dryer (24). Actual heating and cooling rates of heating and cooling cycles are determined based on temperature measurements by the thermistors (35, 45, 52). Heater (34, 44, 49) and cooling loop (37) operation is controlled by comparing measured temperatures with preestablished setpoint temperatures. Malfunctions of system (10) are identified by comparing actual rates with rates characteristic of normal operations. Measured temperature data is validated based on comparing measured temperature with temperature predictions calculated based on heat gain or loss relationships associated with particular heating or cooling cycles. Randomly occurring invalid data is disregarded for control and error diagnosis purposes.

15 Claims, 12 Drawing Sheets

METHOD FOR DETECTING NON-VALID STATES IN FILM PROCESSOR TEMPERATURE CONTROL SYSTEM

This is a continuation-in-part of U.S. patent application Ser. No. 07/738,664, filed Jul. 31, 1991, entitled "Method and Apparatus for Out-of-Rate Error Detection In Film Processor Temperature Control System" which is a continuation-in-part of U.S. patent application Ser. No. 07/495,867, filed Mar. 19, 1990, entitled "Processor With Speed Independent Fixed Film Spacing," now U.S. Pat. No. 5,065,173 which is a continuation-in-part of U.S. patent application Ser. No. 07/494,647, filed Mar. 16, 1990, entitled "Processor With Temperature Responsive Film Transport Lockout" (out U.S. Pat. No. 4,994,837). This application deals with subject matter similar to that of U.S. patent application Ser. No. 07/759,454, entitled "Modification of Film Processor Chemistry Proportional Heating During Replenishment," and Ser. No. 07/759,485, entitled "Control of Temperature in Film Processor In Absence of Valid Feedback Temperature Data," filed on even data herewith, the disclosures of which are incorporated herein by reference.

TECHNICAL FIELD

The present invention relates to processors of film and similar photosensitive media, in general; and, in particular, to a method for the detection of invalid measured temperature data in a system for controlling the temperature of chemicals in such a processor.

BACKGROUND ART

Photosensitive media processors, such as Kodak X-OMAT processors, are useful in applications like the automatic processing of radiographic films for medical imaging purposes. The processors automatically transport sheets or rolls of photosensitive film, paper or the like (hereafter "film") from a feed end of a film transport path, through a sequence of chemical processing tanks in which the film is developed, fixed, and washed, and then through a dryer to a discharge or receiving end. The processor typically has a fixed film path length, so final image quality depends on factors including the composition and temperature of the processing chemicals (the processor "chemistry"), and the film transport speed (which determines the length of time the film is in contact with the chemistry).

In a typical automatic processor of the type to which the invention relates, film transport speed is set at a constant rate and the chemistry is defined according to a preset recommended temperature, e.g. 94° F. (34° C.), with a specified tolerance range of +/−X°. A temperature control system is provided to keep the chemicals within the specified range.

Some processors use a thermowell located in a developer recirculation path to maintain a desired recommended developer chemical temperature. The thermowell has a cartridge heater inserted into one end of a hollow tubular body through which the developer is caused to flow by means of a pump. A thermistor protruding into the thermowell flow path serves to monitor the recirculating developer temperature. The duty cycle of the heater is varied, based upon data received from the thermistor, as a function of the proximity of the measured actual temperature to a preestablished developer setpoint temperature. Until the setpoint temperature is reached, a "wait" light or similar annunciator signals the user that an undertemperature condition exists. Once the setpoint temperature is reached, heating and cooling cycles are initiated, as needed, in accordance with detected temperature variations from the setpoint. Cooling may be accomplished by operation of a solenoid valve which redirects the developer through a loop in the recirculation path which is in heat exchange relationship with cooler water in the wash tank. An overtemperature limit, typically ½° above setpoint temperature, is established as a reference to determine proper operation of the heating control system. If an actual temperature greater than the overtemperature limit is sensed, an overtemperature error is signalled. The fixer, whose temperature is less critical, may have its own thermowell recirculation path or may be maintained at a temperature close to the developer temperature by directing it in heat exchange relationship with the developer.

While processors used for radiographic image processing are traditionally configured to operate at a single film transport speed and developer setpoint temperature, new processors have been introduced which are settable as to transport speed and temperature, so the same processor can be used for multiple processing modes. A particular mode is often referred to by a shorthand designation indicative of its associated "drop time," which corresponds to the time lapse from entry of the leading edge of a film at the feed end of the processor, until exit of the trailing edge of the same film at the discharge end. Kodak uses the designations "Kwik" or "K/RA," "Rapid," "Standard," and "Extended" to refer to different user-selectable operating modes, each of which has its own characteristic transport speed and developer setpoint temperature.

The operations and functions of automatic film processors are handled under control of electronic circuitry, including a microprocessor connected to various process sensors and subsidiary controls to receive and dispense electronic signals in accordance with predefined software program instructions. Examples of such control circuitry are shown in U.S. Pat. No. 4,300,828 and in U.S. patent application Ser. No. 07/494,647, the disclosures of both of which are incorporated herein by reference.

If film is run through a processor at system start-up or during a change of mode, before the chemistry temperature has reached the designated setpoint setting for the selected mode, the image development may well be of substandard quality and, in worst case, not readable at all. For diagnostic imaging, this may necessitate retake with consequential patient inconvenience and additional radiation exposure. In cases of radiographic imaging utilized for progress monitoring purposes during a surgical operating procedure, this may lead to other undesirable consequences. It is, therefore, desirable to be able to prevent processing of exposed photosensitive media until setpoint temperatures are reached. This may be accomplished by configuring the temperature control circuitry to indicate a "ready" condition only when the developer, and optionally the fixer, chemicals reach their desired operating temperatures (i.e, until they are within X. of their setpoint temperatures). U.S. patent application Ser. No. 07/494,647 describes a system whereby the film drive transport mechanism is disabled to prevent the introduction of fresh film, until desired chemical temperatures are attained.

It is also desirable to be able to indicate a failure of the temperature control system. This is done conventionally by establishing an upper limit value, above which chemistry temperature would not normally be expected to go. This has the advantage of indicating an unacceptable overtemperature condition once setpoint temperature is reached, but provides no indication of improper operation prior to reaching setpoint. If the heat gain per unit time is too low, setpoint temperature may never be reached.

U.S. patent application Ser. No. 07/738,664, entitled "Method and Apparatus for Out-of-Rate Error Detection In Film Processor Temperature Control System filed Jul. 31, 1991 describes a processor temperature control system in which malfunctions in operation of heating and cooling cycles are determined utilizing comparisons of actual and normal rates of change in chemical or dryer air temperature over time. Failures are indicated based on comparisons of time variations in measured actual temperatures for a given heating (or cooling) cycle, with expected variations for the same cycle assuming normal rates of heating (or cooling) under normal temperature control system operating conditions. If the actual rate of measured temperature increase (or decrease) deviates by more than a preestablished acceptable tolerance from the expected normal rate of increase (or decrease), an error is indicated. The system can be set to shut down the processor or disable the film drive transport mechanism (with user-controllable override) to prevent the introduction of fresh film, if the error is not corrected. Such rate error detection scheme enables the rapid determination of temperature control system malfunction, prior to attainment of setpoint temperatures and flags errors which conventional error detection means would miss.

Regardless of the procedures employed for operational control or error diagnosis, processor temperature control systems suffer from the random occurrence of invalid actual temperature measurement data due to electrical noise or similar transients. This can interfere with normal temperature control functioning as, for example, by causing false starts of heating or cooling cycles, which themselves then result in unnecessary departures from equilibrium that have to be corrected. Wrong data can also cause false error designations leading to unnecessary lockouts or shutdowns or, at a minimum, to user annoyance.

DISCLOSURE OF THE INVENTION

It is an object of the present invention to provide a method for detecting and disregarding random occurrences of invalid temperature data in a system for controlling the temperature of chemicals in an automatic film processor.

In accordance with the invention, a system for controlling the temperature of chemicals in an automatic film processor includes means for generating data corresponding to actual temperatures of the chemicals occurring at successive times, and means for determining the validity of the generated data based on comparisons of the measured actual temperatures with predictions as to what valid actual temperature states should be, given the heat gains (or losses) applied in the system during the time interval between measurements.

An embodiment of the invention, described in greater detail below, is employed with a general purpose radiographic film processor having means for automatically transporting film through developer, fixer, wash and dryer stations according to a selected one of a plurality of available film processing modes, each having an associated characteristic film transport speed and developer setpoint temperature. Data corresponding to measured actual developer temperatures occurring at successive times is generated for control and diagnostic purposes under microprocessor supervision, based on measurements taken at periodic time intervals by a temperature sensor in contact with developer flowing in a recirculation path. The measured actual temperatures are compared with predictions as to what the actual temperature states should be, considering the possible heat gains (or losses) per unit time for the applied heating (or cooling) cycle. If a measured actual temperature deviates from a corresponding predicted temperature by more than a predetermined tolerance factor, that measurement is disregarded for control and error diagnosis purposes. Similar non-valid state detection mechanisms are provided for fixer chemical and dryer air temperature data.

BRIEF DESCRIPTION OF THE DRAWINGS

Embodiments of the invention have been chosen for purposes of illustration and description and are shown in the accompanying drawings, wherein.

Throughout the drawings, like elements are referred to by like numerals.

MODE OF CARRYING OUT THE INVENTION

The principles of the invention are illustrated, by way of example, embodied in the form of a temperature control system 10 (FIGS. 3–4) suitable for use with a processor 12 (FIGS. 1 and 2) having four user-selectable film modes for the automatic processing of photosensitive film F (FIG. 2), such as for the development of radiographic images for medical diagnostic purposes. Associated with each mode are default parameters for transport speed; developer and fixer replenishment volumes; developer, fixer and dryer setpoint temperatures; and so forth. Such parameters are stored in memory, but can be modified through user input.

Figure 1:
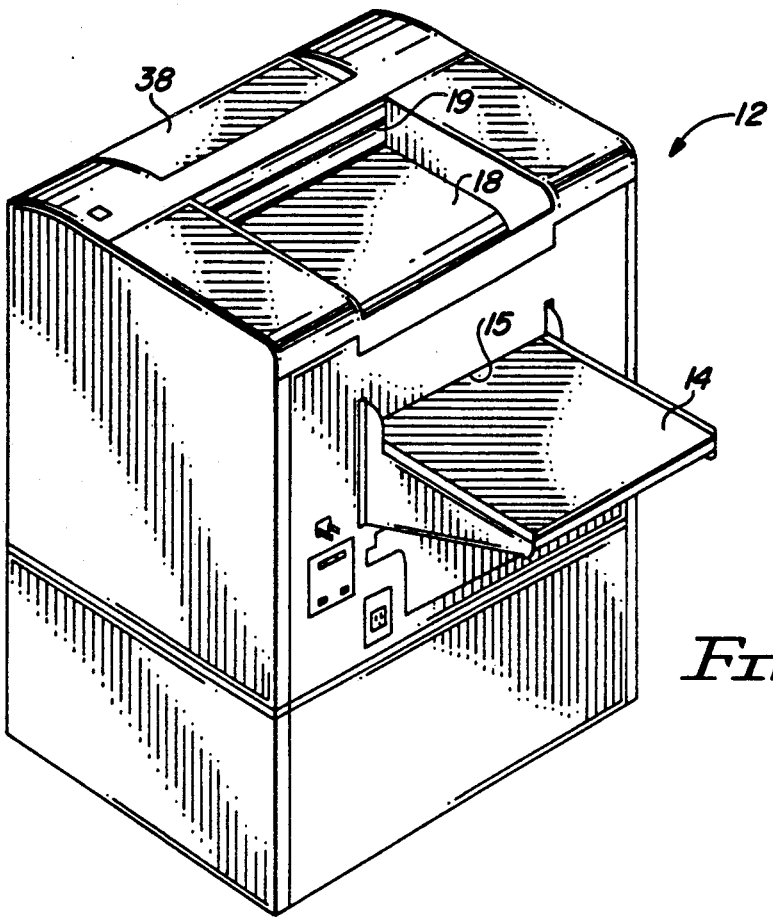
FIG. 1 is a perspective view of a processor in which a temperature control system incorporating the present invention can be employed.
Figure 2:
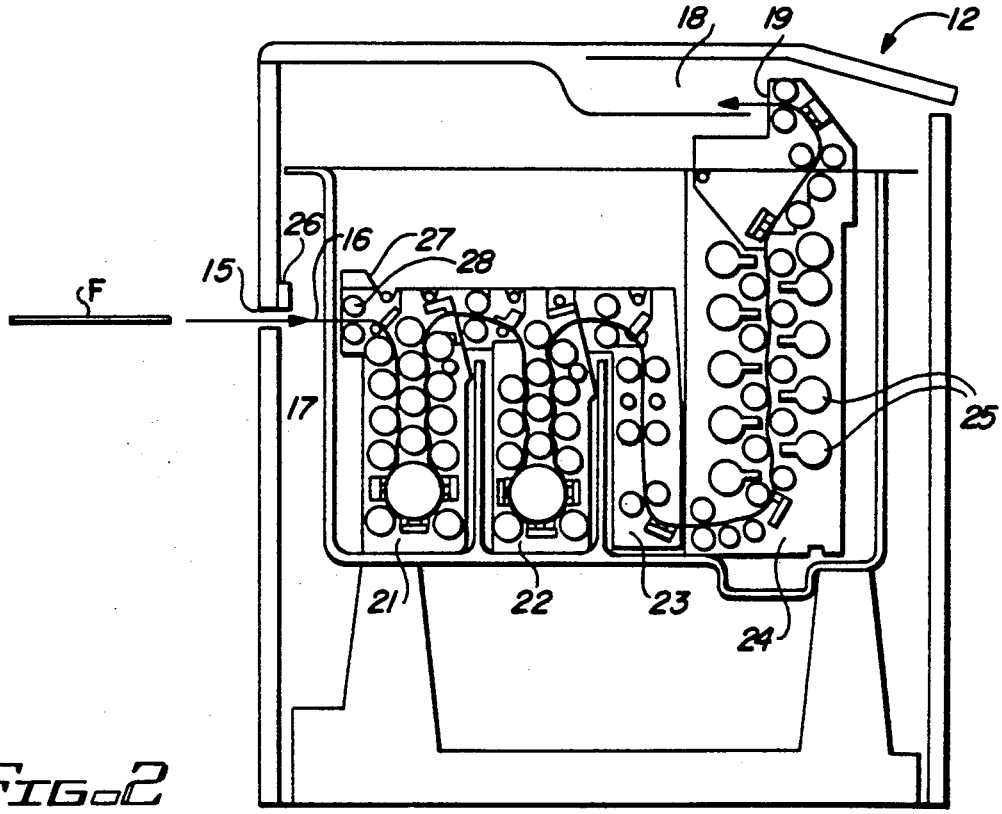
FIG. 2 is a schematic representation of relevant elements of the processor of FIG. 1.

The processor 12 has a feed tray 14 positioned ahead of an entrance opening 15 (FIG. 1). Patient film F (FIG. 2) entered through entrance opening 15 is transported through processor 12 along a travel path 16 (indicated by arrows in FIG. 2) by a network of conventional motor shaft-driven rollers 17, and eventually into a catch bin 18 at an exit opening 19. The path 16 includes travel through a developing station comprising a tank 21 filled with developer chemical; a fixing station comprising a tank 22 filled with fixer chemical; and a wash station comprising a tank 23 filled with wash water or comprising some other appropriate film washing device. Processor 12 also includes a drying station 24 comprising oppositely-disposed pluralities of air dispensing tubes 25 or other appropriate film drying mechanism.

Positioned proximate opening 15 is a sensor 26, such as a conventional reflective infrared LED sensor array, which provides a signal indicative of film width when film F is presented at the entrance opening 15. The film width sensor 26 also provides an indication of the occurrence of passage of the leading edge and trailing edge of film passing point 26 of the processor 12, since the signal from the sensor 26 will change significantly as each leading and trailing edge is encountered. A second sensor 27, in the form of a reed switch or the like, may be provided to detect separation of the entrance rollers 28 to signal the beginning of transportation of film F along the path 16.

The temperature of developer chemical in tank 21 may be controlled by means of a developer recirculation path 30 (shown in dot-dashed lines in FIG. 3) having a pump 31 for drawing developer out of tank 21, passing it through a thermowell 33 incorporating a heater 34 or other suitable heating device, and then passing it back to the tank 21. The path 30 also includes means for cooling the developer, such as a solenoid valve 36 which may be operated to redirect the developer through a loop 37 in heat exchange relationship with cooling water in water tank 23. The flow of water in tank 23 (see dot-dot-dashed lines in FIG. 3) is under control of a solenoid valve 39. A temperature sensor 35 (FIG. 4) is provided in the tank 21 or recirculation path 30 to monitor the temperature of the developer. The sensor 35 may, for example, be a thermocouple provided in the thermowell 33. Developer temperature may be displayed on a panel 38 (FIG. 1) located externally on the processor 12.

The temperature of fixer chemistry may be controlled in a similar manner by means of a fixer recirculation path 40 (shown in solid lines in FIG. 3) having a pump 41 for drawing fixer out of tank 22, passing it through a thermowell 43 incorporating a heater 44 or other suitable heating device, and then passing it back to the tank 22. A temperature sensor 45, such as a thermocouple similar to thermocouple 35, is provided in the tank 22 or recirculation path 40 to monitor the temperature of the fixer. Maintaining the setpoint temperature of the fixer is less critical than maintaining the setpoint temperature of the developer, so no cooling loop is provided.

The temperature of air in the dryer 24 can be maintained by energizing a blower motor 48 and air heater 49 (FIG. 4) to drive warm air through the tubes 25 (FIG. 2) and across the surface of film F. A temperature sensor 52, similar to thermocouple 35 or 45, may be located in the air path to monitor dryer air temperature. It will be appreciated that other ways of controlling processor chemistry and dryer temperatures may be employed.

Recirculation of developer and fixer takes place when the developer and fixer tanks 21, 22 are full. The "full" condition is detected by level sensing sensors 50, 51 (FIG. 4) located in communication with the tanks 21, 22. Developer and fixer replenishment occurs automatically if the level falls below a predefined desired level. This is accomplished for the developer by energizing a replenishment pump 53 (FIG. 3) connected at its input side to a supply of replenishment developer 54 and at its output side to a filter assembly 55 located in fluid communication with the developer tank 21. For the fixer, replenishment is similarly accomplished by energizing of a replenishment pump 56 connected at its input side to a supply of replenishment fixer 57 and at its output side to a filter assembly 58 located in fluid communication with the fixer tank 22.

The sensors 50, 51 may be of a type having one contact in the form of a probe exposed to the solution and another contact grounded to the case of the heater 34 or 44. The probe can be located to monitor solution level in the main tank 21 or 22 or in an associated level-sensing auxiliary reservoir. When the probe becomes immersed in solution, a path is provided to ground and the resistance of the sensor circuit is lowered. The value of the lowered resistance indicates the level of the solution.

Figure 4:
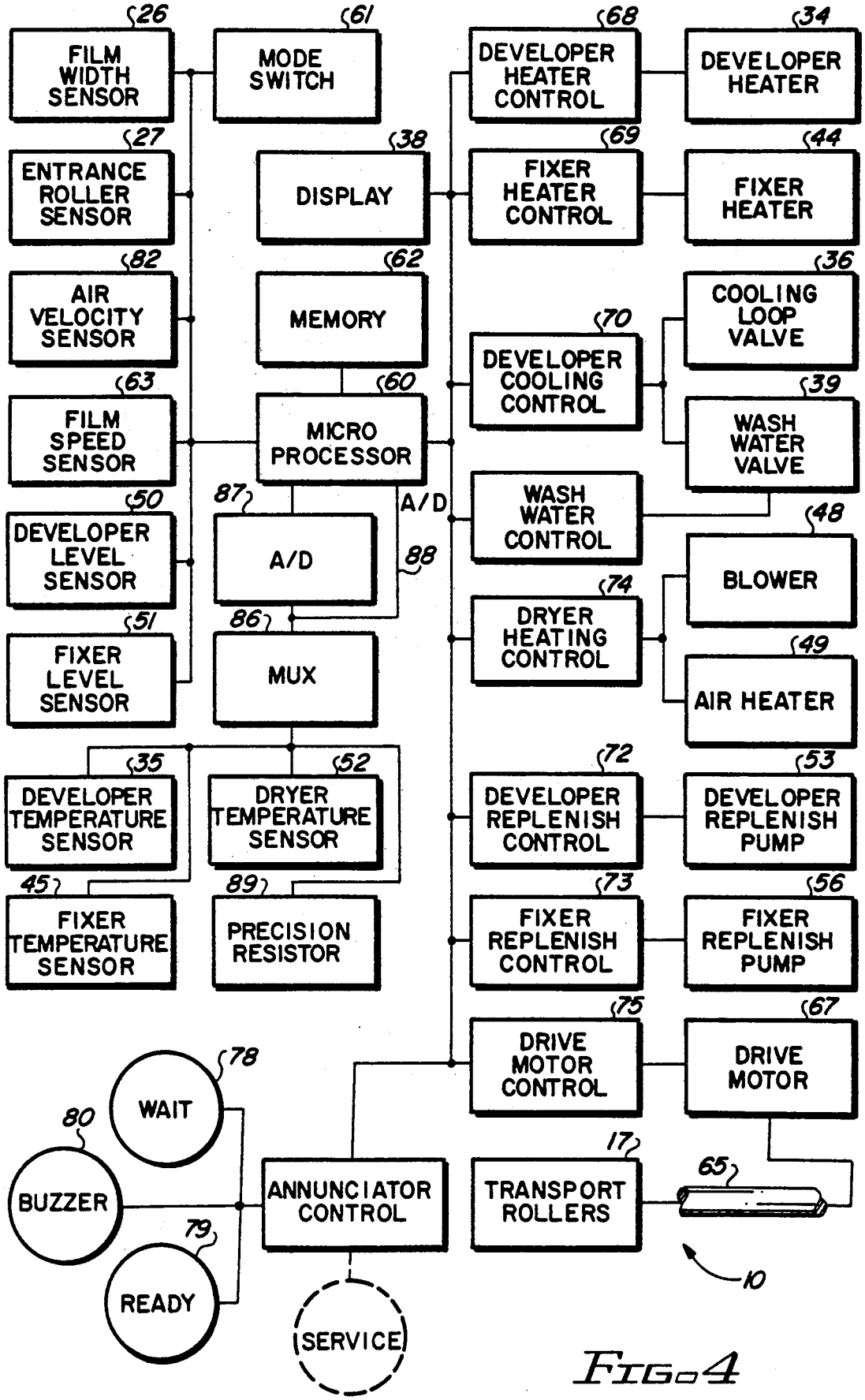
FIG. 4 is a block diagram of the control system employed in the processor.
Figure 5A:
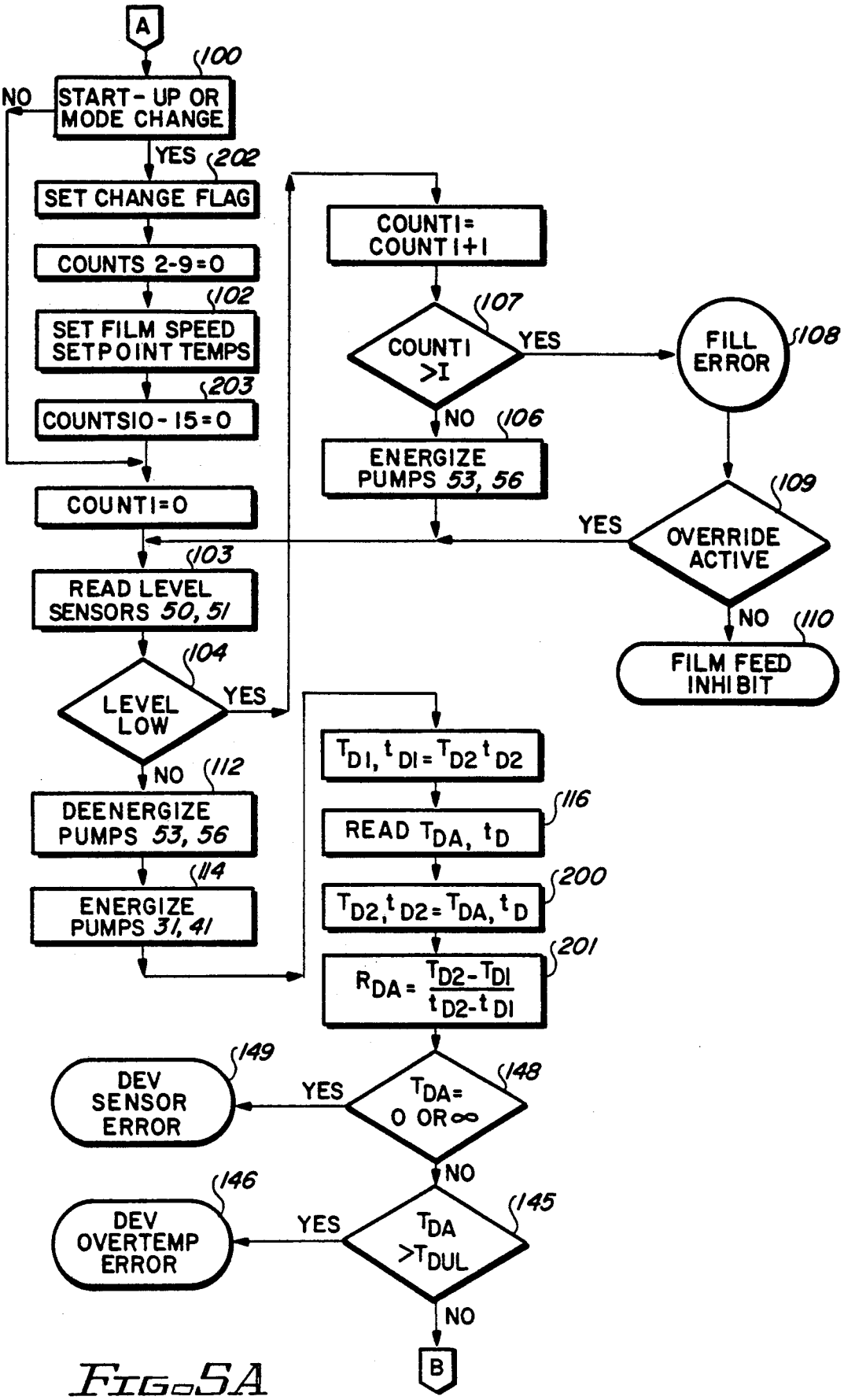
FIGS. 5A–5E (hereafter collectively referred to as FIG. 5) are respective portions of a single flow diagram.
Figure 5B:
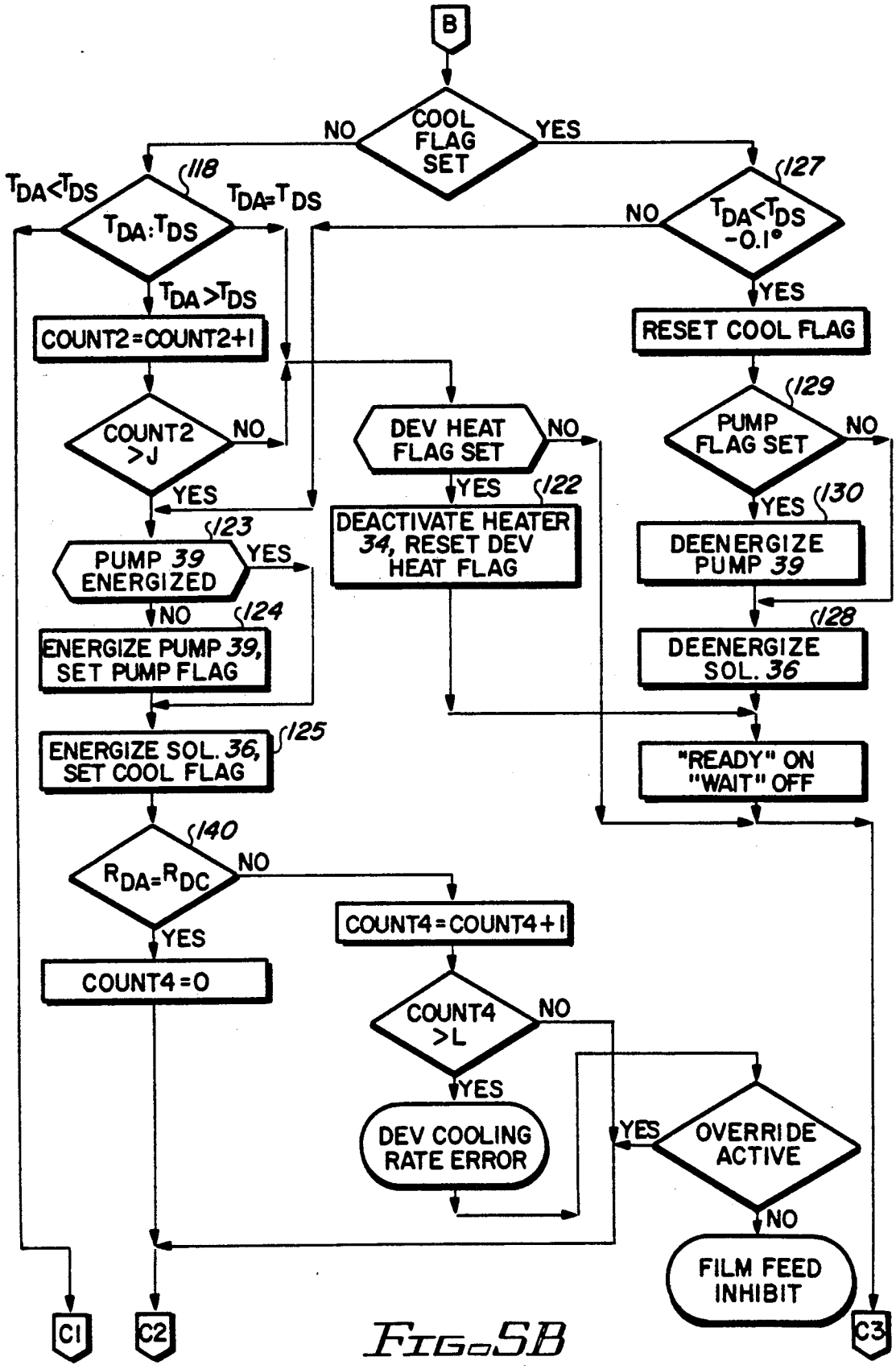
Figure 5C:
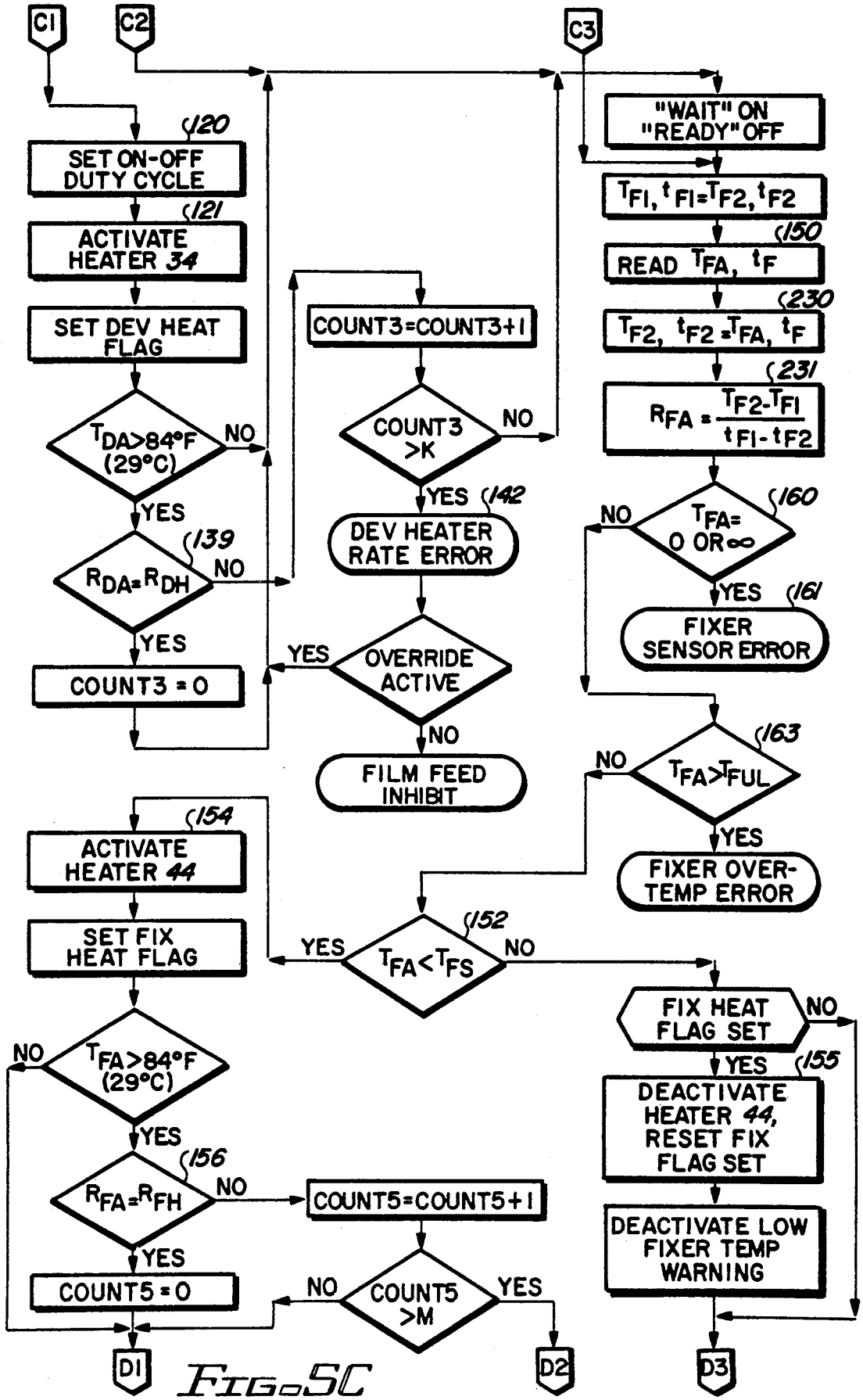
Figure 5D:
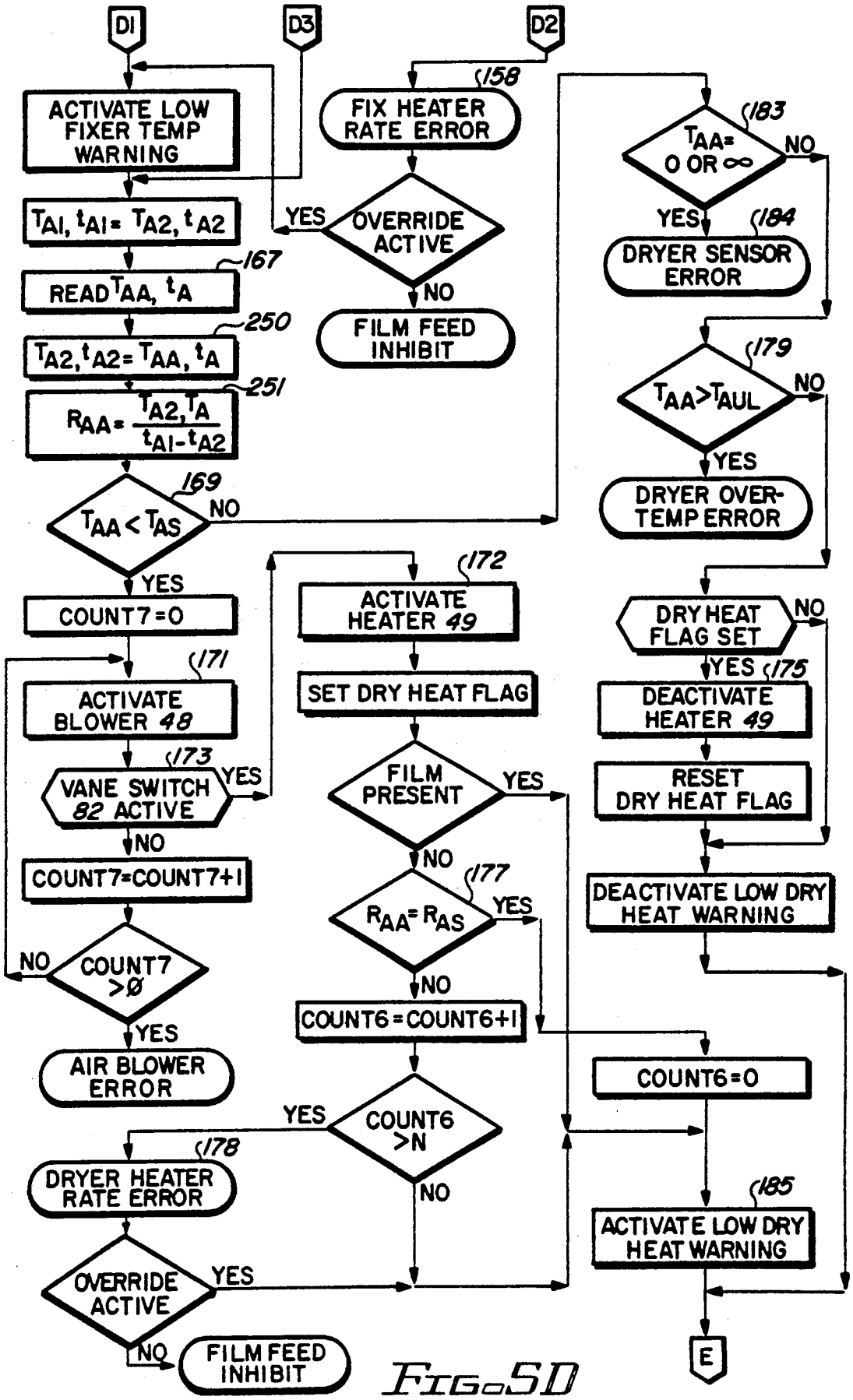
Figure 5E:
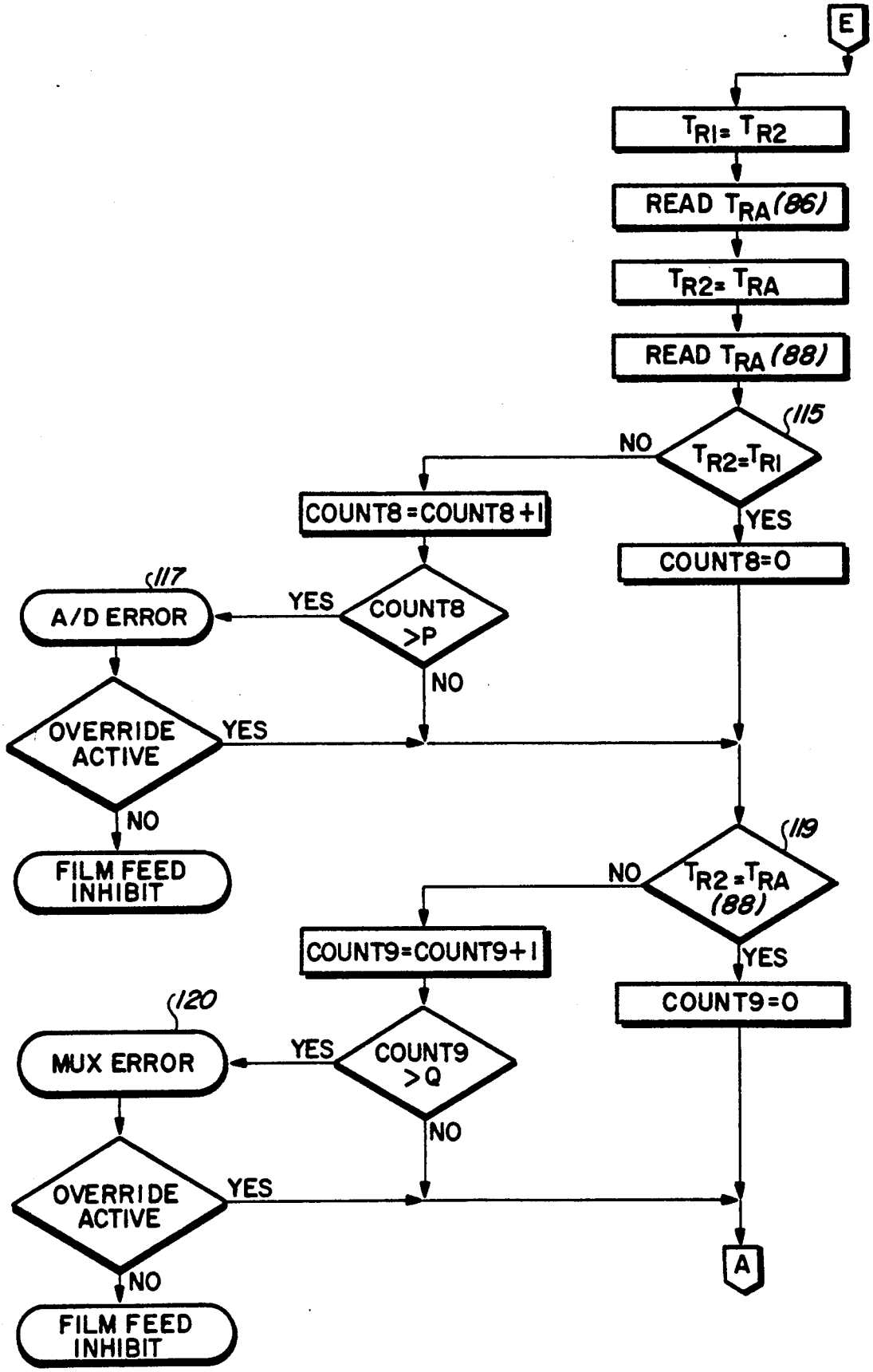

FIG. 4 illustrates a control system usable in implementing an embodiment of the present invention. As shown, a microprocessor 60 is connected to direct the operation of the processor 12. Microprocessor 60 receives input from the user through a mode switch 61 as to what processor mode of operation is desired. The system can be configured to enable the user to select among predesignated modes, such as "Kwik" or "K/RA," "Rapid," "Standard," or "Extended" modes, each having predetermined associated film path speed and chemistry temperature parameters prestored in a memory 62. The system can also be configured to permit a user to input a desired path speed and temperature directly into memory 62.

One way to implement mode switch 61 is by means of an alphanumeric keypad associated with display 38 (FIG. 1) for providing programming communication between the user and the microprocessor 60. For example, a function code can be entered to signal that mode selection is being made, followed by a selection code to designate the selected mode. Alternatively, a function code can be entered for film path speed or chemistry temperature, followed by entry of a selected speed or temperature setting. Another way to implement switch 61 is by means of a plurality of push button or toggle switches, respectively dedicated one for each selectable mode, and which are selectively actuated by the user in accordance with user needs.

Microprocessor 60 is connected to receive input information from the film width sensor 26, the entrance roller sensor 27, the developer, fixer and dryer temperature sensors 35, 45, 52, the developer and fixer level sensors 50, 51, and from various other sensors and feedback controls. The sensors 26, 27 provide the microprocessor 60 with information on the leading and trailing edge occurrences and the width of film F. This can be used together with film speed from a sensor 63 (FIG. 4) which measures the speed of shaft 65 of motor 67 used to drive the rollers 17 (FIG. 2), to give a cumulative processed film area total that guides the control of chemistry replenishment. The entrance roller sensor 27 signals when a leading edge of film F has been picked up by the roller path 16. This information can be used together with film speed and known length of the total path 16 to indicate when film F is present along the path 16.

As shown in FIG. 4, microprocessor 60 is connected to heater control circuitry 68, 69, cooling control circuitry 70, replenishment control circuitry 72, 73, dryer control circuitry 74, drive motor control circuitry 75 and annunciator control circuitry 77. Heater control circuitry 68, 69 is connected to heaters 34, 44, and cooling control circuitry 70 is connected to valves 36, 39 (FIGS. 3 and 4), to control the temperature of the developer and fixer flowing in the recirculation paths 30, 40 (FIG. 3) and, thus, the temperature of the developer and fixer in tanks 21, 22. Replenishment control circuitry 72, 73 is connected to valves 53, 56 to control the replenishment of developer and fixer in tanks 21, 22. Dryer control circuitry 74 is connected to dryer blower motor 48 and air heater 49 to control the temperature of air in dryer 24. Drive motor control circuitry 75 is connected to motor 67 to control the speed of rotation of drive shaft 65 and, thus, of rollers 17. This regulates the speed of travel of film F along film path 16 and, thus, determines the length of time film F spends at each of the stations (i.e., controls development, fixer, wash and dry times). Annunciator control circuitry 77 is connected to control the on/off cycles of annunciators in the form of a "Wait" light 78, a "Ready" light 79, and an audible alarm or buzzer 80.

The invention takes into account that, under normal functioning of heating (or cooling) cycles, the heat gain (or loss) per unit time Q experienced by the developer or fixer solutions will follow general principles of thermodynamics, as follows:

Q=(rate of energy influx to the solution)−(rate of energy influx from the solution).

Thus, for a given mass m of solution having a specific heat $C_p$, the amount of heat per unit time needed to raise the temperature of the solution by an increment ΔT can be expressed as:

$$Q=mC_p\Delta T.$$

A heat gain (or loss) per unit time applied for a time increment Δt to the same solution can thus be expressed as:

$$Q\Delta t=mC_p\Delta T.$$

So, applying a known heat rate Q for a time Δt to a known mass m of solution having an initial temperature $T_1$ should, under normal circumstances, result in a new temperature $T_2$, defined by:

$$T_2 = T_1 + \frac{Q\Delta t}{mC_p}$$

Mathematical modeling of the thermal system of an automatic processor such as the processor 12 is described in "Ambient Water Thermal Control System" by Kenneth W. Oemcke, Department of Mechanical Engineering, Rochester Institute of Technology, Rochester, New York, July 1978. Applying such techniques to the developer and fixer recirculation paths 30, 40 of FIG. 3, yields the following expressions for normal operation of heating (or cooling) cycles for developer and fixer in processor 12:

$$T_{D2} = T_{D1} + \frac{Q_D(t_{D2} - t_{D1})}{m_D C_{PD}};$$

and $$T_{F2} = T_{F1} + \frac{Q_F(t_{F2} - t_{F1})}{m_F C_{PF}};$$

expressed in terms of developer and fixer temperatures $T_{D2}$, $T_{F2}$, and $T_{D1}$, $T_{F1}$ taken at times $t_{D2}$, $t_{F2}$ and $t_{D1}$, $t_{F1}$; and flow rates $m_D$, $m_F$ of developer and fixer through the thermowells 33, 43, respectively. The replenishment cycles function to keep the mass of solution flowing in the paths 30, 40 constant for a particular operating mode.

The operation of the control system 10 in accordance with the invention is described with reference to FIGS. 5–10.

Figure 3:
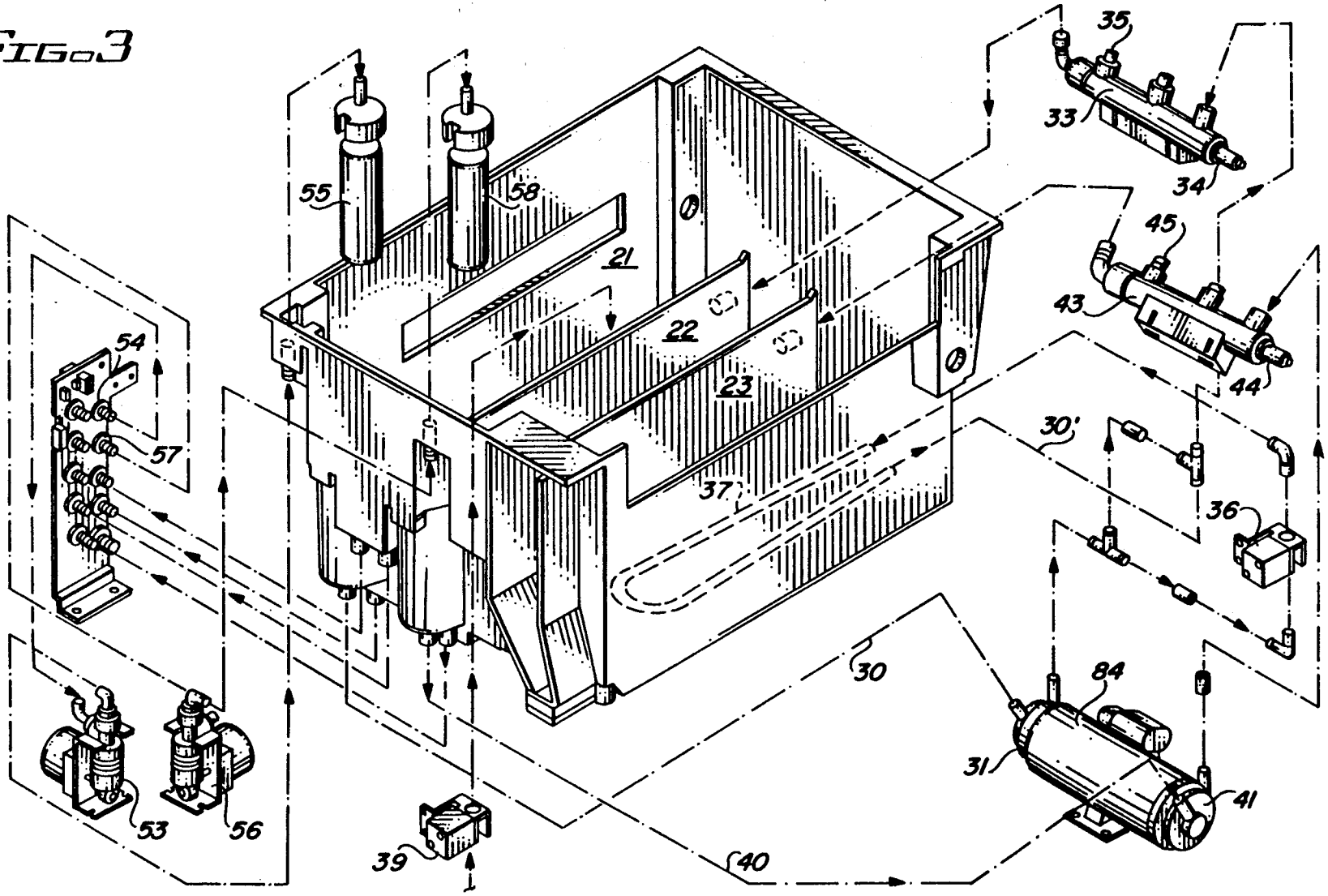
FIG. 3 is a schematic diagram showing the developer and fixer recirculation paths.

When power is applied at start-up, or processor 12 is reset to a different mode (100 in FIG. 5), the system is initialized and system variables, including film speed and setpoint temperatures, are set (102). The wash water solenoid 39 is energized, allowing water to flow into the tank 23; and the developer and fixer solution levels are checked by reading sensors 50, 51 (103). If the levels are low, replenishment cycles are activated, as necessary, energizing pumps 53, 56 to fill the tanks 21, 22 (104, 106). If the levels do not reach their preset target levels within a predetermined time (e.g., count 1=I=4 minutes), a tank fill error occurs (107, 108). In the absence of activation by the user of an override (109), the fill error signal will sound a buzzer 80 (FIG. 4), disable the drive motor 67 (FIG. 4), or otherwise inhibit the feeding of fresh film F (110) until the error is cleared. If the correct levels are reached, pumps 53, 56 are deenergized (112) and recirculation pumps 31, 41 are energized to flow the solutions along the recirculation paths 30, 40 (114). In the shown embodiment, the pumps 31, 41 are magnetically coupled on opposite sides of a single recirculation motor 84 (FIG. 3). It will be appreciated however, that separate pump motors can be used.

Figure 9:
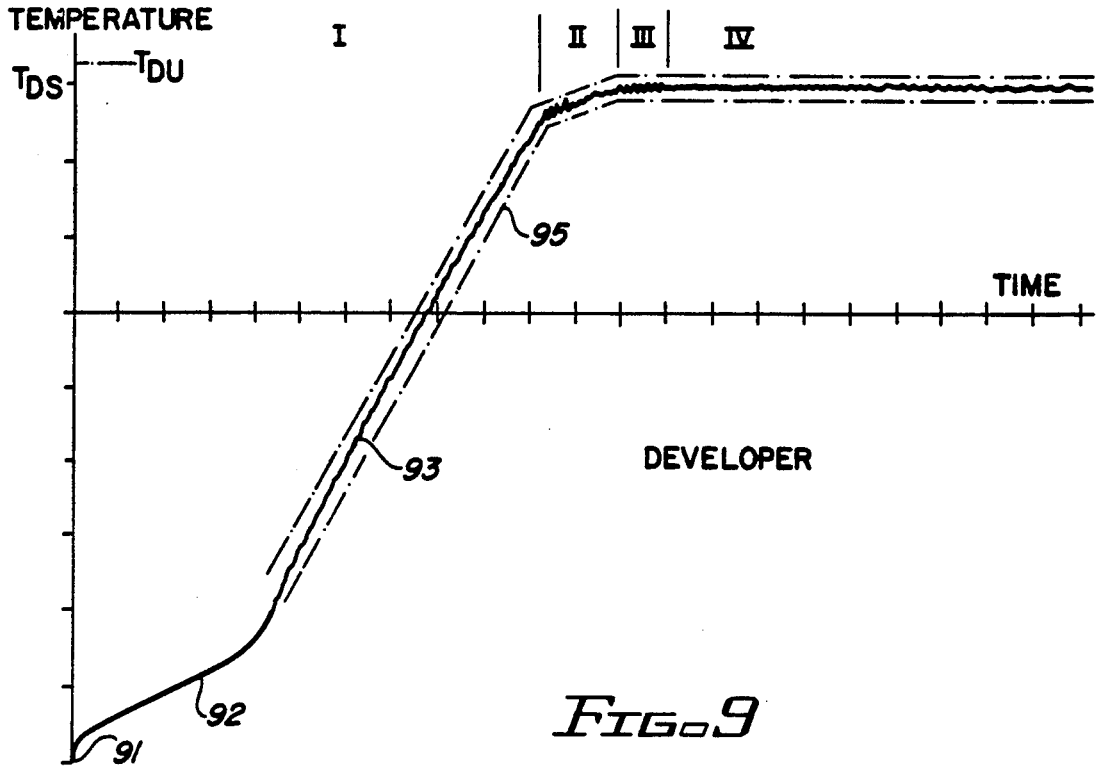
FIGS. 9 and 10 are graphical representations of time variations of temperature over time during processor operation for typical developer and fixer chemical solutions.
Figure 10:
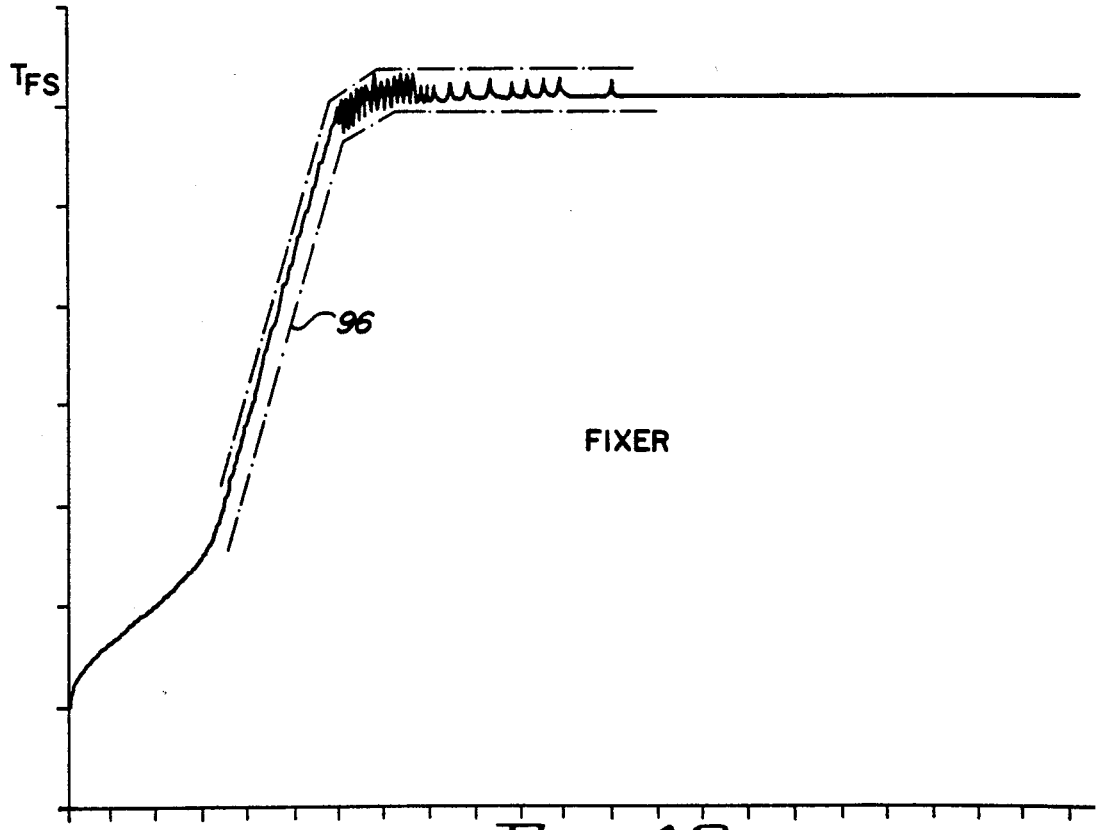

Microcomputer 60 uses algorithms and controls to monitor the temperatures of the developer, fixer and dryer air based on signals received from the sensors 35, 45, 52. The temperatures of developer and fixer within the paths 30, 40 should increase at normal rates following an initial warm-up period of several minutes after start-up or reset. FIGS. 9 and 10 illustrate the relationship between temperature and time for the developer and fixer chemicals for normal heating (and cooling) cycles from system start-up through successful attainment of setpoint temperature.

The developer, fixer and dryer thermistors 35, 45, 52 may suitably be connected for shared component processing, to multiplexer circuitry 86 and an analog-to-digital (A/D) converter 87 (FIG. 4). The multiplexer circuitry 86 sets the channel and voltage range for the A/D converter 87. The microprocessor 60 checks for two different errors with the thermistors: wrong A/D temperature conversions, and opened or shorted thermistors. The temperature conversions are monitored through a precision resistor 89, which is read at periodic intervals to verify the accuracy of the A/D conversion. If the value of resistor 89 is not correct for a predefined number of consecutive readings, the A/D converter 87 is considered faulty. An opened or shorted thermistor is determined by reading an internal A/D in the microprocessor 60 (line 88 in FIG. 4) at the same time as the control A/D converter 87 for the developer, fixer and dryer sensor channels. If the readings on the internal A/D fall outside of the allowed range for a predefined number of consecutive readings, the thermistor is considered faulty. An error in the multiplexer circuit can be detected by comparing readings of the resistor 89 taken using the external A/D converter 87 and using the internal A/D converter 88 (119, 120). These checks are not performed until a time delay period of e.g., three minutes, has elapsed after power-up. This delay prevents open thermistor errors due to cold solution temperatures or cold ambient.

Developer Temperature Control

While the developer is recirculating (114), thermistor 35 in the thermowell 33 monitors actual developer temperature $T_{DA}$ at time $t_D$ (116). The resistance of the thermistor 35 changes inversely with the temperature of the solution. This data is sent to the microprocessor 60, which controls the heating and cooling systems.

The actual developer temperature $T_{DA}$ is determined by performing an analog-to-digital (A/D) conversion on the resistance of the thermistor 35. This data is then converted to a temperature of ° C. or ° F. by means of a software algorithm. The temperature is then compared to the setpoint temperature $T_{DS}$ previously stored in memory 62 to determine if heating or cooling is required (118). The temperature is read periodically at intervals of $\Delta t$, e.g., every ½ or ¾ second.

Optimum processing quality occurs when the developer temperature is maintained substantially at its setpoint temperature $T_{DS}$. A tolerance of ±X°, determined by user input or default, may be allowed (118). If the developer is below setpoint $T_{DS}$, the heater 34, located inside the thermowell 33, is controlled to pulse on and off at a duty cycle defined by microprocessor 60 based on the temperature data received from the thermistor 35 (120, 121).

The heating of the developer is controlled by a proportional method. Heater 34 is turned on full until the temperature $T_{DA}$ measured by sensor 45 is within 0.5° of the preestablished setpoint $T_{DS}$. This is shown by region I in FIG. 9. Region I is characterized by an initial portion 91 having a steep rise due to the effect of heater 34 of developer in thermowell 33 prior to recirculation; a second, reduced slope portion 92 which is influenced by the cooling effect of introduced replenishment solution and heat losses due to residual ambient cooling; and, finally, a third region 93, starting about 4 minutes into the cycle, marked by an almost linear rise of net heat gain due to the heater 34 over system and ambient heat losses. Heater 34 then operates on a duty cycle of 75% over a region II shown in FIG. 9, until the temperature $T_{DA}$ measured by sensor 45 comes within 0.3° of the setpoint $T_{DS}$. Heater 34 then operates on a duty cycle of 50% over a region III, until the temperature $T_{DA}$ is within 0.1° of the setpoint $T_{DS}$. And, finally, heater 34 operates on a duty cycle of 25% in a steady state region IV, until the setpoint temperature $T_{DS}$ is reached. When the setpoint temperature $T_{DS}$ is reached, the developer heater shuts off (122). FIG. 9 is plotted for a processing mode having a developer setpoint temperature of $T_{DS}$=95° F. (35° C.) with time marked in intervals of 75 readings of ¾ second spacing each, and with temperature marked in intervals of 500 in decimal on a 12-bit A/D converter 87 (which corresponds to interval spacings of about 1.6° each). The origin of the temperature axis occurs at 90° F. (32.2° C.).

If the developer temperature $T_{DA}$ sensed by the sensor 45 is 0.3° or more than the setpoint $T_{DS}$ for J=5 consecutive readings, a cooling cycle is activated. If not already energized, the wash water solenoid 39 is activated to flow water in the tank 23 around the heat exchanger loop 37 (123, 124). The developer cooling solenoid 36 is then energized (125), allowing developer in the recirculating path 30 to circulate through the loop 37. The cooler water in the tank 23 surrounding the heat exchanger 37 acts to cool the developer. The cooler developer then returns to the main recirculation path 30 and back to the tank 23. The cooling cycle continues until the developer temperature $T_{DA}$ drops to 0.1° below the setpoint $T_{DS}$ for one reading of the developer thermistor 35 (127). The developer cooling solenoid 36 then deenergizes, shutting off the developer supply to the heat exchanger 37 (128). If pump 39 was not already energized when the cooling cycle began, it too is shut off (129, 130). For most effective functioning of the developer cooling system, the temperature of water flowing in the wash tank 23 should preferably be at a temperature 10° F. (6° C.) or more below the operating setpoint $T_{DS}$ of the developer temperature.

The developer heating and cooling systems are responsible for maintaining the developer at the current processing mode temperature setpoint $T_{DS}$ under all operating conditions. The developer solution should stabilize at the setpoint temperature $T_{DS}$ within 15–20 minutes after start-up, and within 5 minutes after a mode change. In accordance with the out-of-rate error detection procedure of U.S. patent application Ser. No. 07/738,664, the rate of change of temperature of the developer is monitored (139, 140) to ensure that it is within acceptable limits. If the rate of change for the developer temperature is not within the tolerance of normally expected rate of change, the processor will display an error message (142, 143). This differs from conventional methods which look only at absolute temperatures to determine whether the measured actual temperature $T_{DA}$ exceeds a prespecified maximum developer temperature limit $T_{DUL}$ (FIG. 9) at any time. If it does, an overtemperature error occurs. Absolute temperature overtemperature protection is provided in the depicted embodiment (145, 146). However, in addition, for each heating or cooling cycle, the actual rate of change in developer temperature $R_{DA}=(T_{D2}-T_{D1})/(t_{D2}-t_{D1})$ that actually occurs (200) is compared with a predetermined acceptable change in developer temperature $R_{DS}$ ($R_{DH}$ or $R_{DC}$) that should occur if that heating or cooling cycle is functioning normally. If the difference between the predicted change and the actual change exceeds a preestablished tolerance ±Y. per second, a rate error is flagged. A "loss of developer heating ability" or "loss of developer cooling ability" error is displayed. These errors are cleared when either the rate corrects itself or the setpoint temperature $T_{DS}$ is reached (115). Should the error persist and not correct itself, a buzzer signal, drive transport lockout or other fresh film feed inhibit routine can be invoked, subject to a user selectable override.

If thermistor 35 is open- or short-circuited, or the temperature control A/D converter is not operating correctly, an "unable to determine developer temperature" error message will be displayed (148, 149). This error will not normally be cleared unless the processor is deenergized and then energized again.

The cooling rate is checked as long as cooling is needed. The heat rate is checked when the developer is on full; the temperature of the solution is above 84° F. (29° C.) or ten minute timeout occurs; and the replenish pumps are off. For the depicted embodiment, the minimum heating rate $R_{DH}$ (139) calls for an increase of 2.0 every 2 minutes; and the minimum cooling rate $R_{DC}$ (140) calls for a decrease of 0.1° every 3 minutes.

Electrical noise or similar transients experienced by the electrical control system 10 can lead to random occurrences of invalid temperature measurements $T_{DA}$ (116). Comparisons of erroneous values of $T_{DA}$ with setpoint temperature $T_{DS}$ for heating or cooling cycle control purposes (118, 127), can lead to unintended heating or cooling cycle activations or deactivations. Such unintended activity may upset the temperature balance of the system, requiring otherwise unnecessary additional corrective heating or cooling operations. Furthermore, comparisons of erroneous values of $T_{DA}$ with preestablished allowable temperature limits $T_{DUL}$ (145), or of rates $R_{DA}$ based on erroneous values of $T_{DA}$ with predetermined acceptable rates $R_{DH}$, $R_{DC}$ (139, 140), can lead to false error designations (146, 142, 143), leading to unintended interference with normal processing.

In accordance with the invention, the validity of the temperature $T_{DA}$ of developer measured at a time $t_D$ is verified to determine its correspondence with a temperature $T_{DP}$ predicted for the developer for the same time $t_D$, given a known starting temperature $T_{D1}$ at time $t_{D1}$ and known heat gain (or loss) relationships applicable for the heating or cooling cycle to which the developer is subjected during the time interval from $t_{D1}$ to $t_D$. Because the developer temperature changes relatively slowly, the temperature state of the developer can only change by a certain amount in any given time interval for any given heating or cooling cycle. Thus, a measured temperature $T_{DA}$ that deviates from the predicted value $T_{DP}$ by more than a preestablished tolerance $\pm Z°$ corresponds to a developer temperature state which cannot exist and is, thus, invalid. In accordance with the invention, random occurrences of erroneous data $T_{DA}$ indicative of non-valid temperature states are identified and disregarded for control and error diagnosis purposes.

Figure 6:
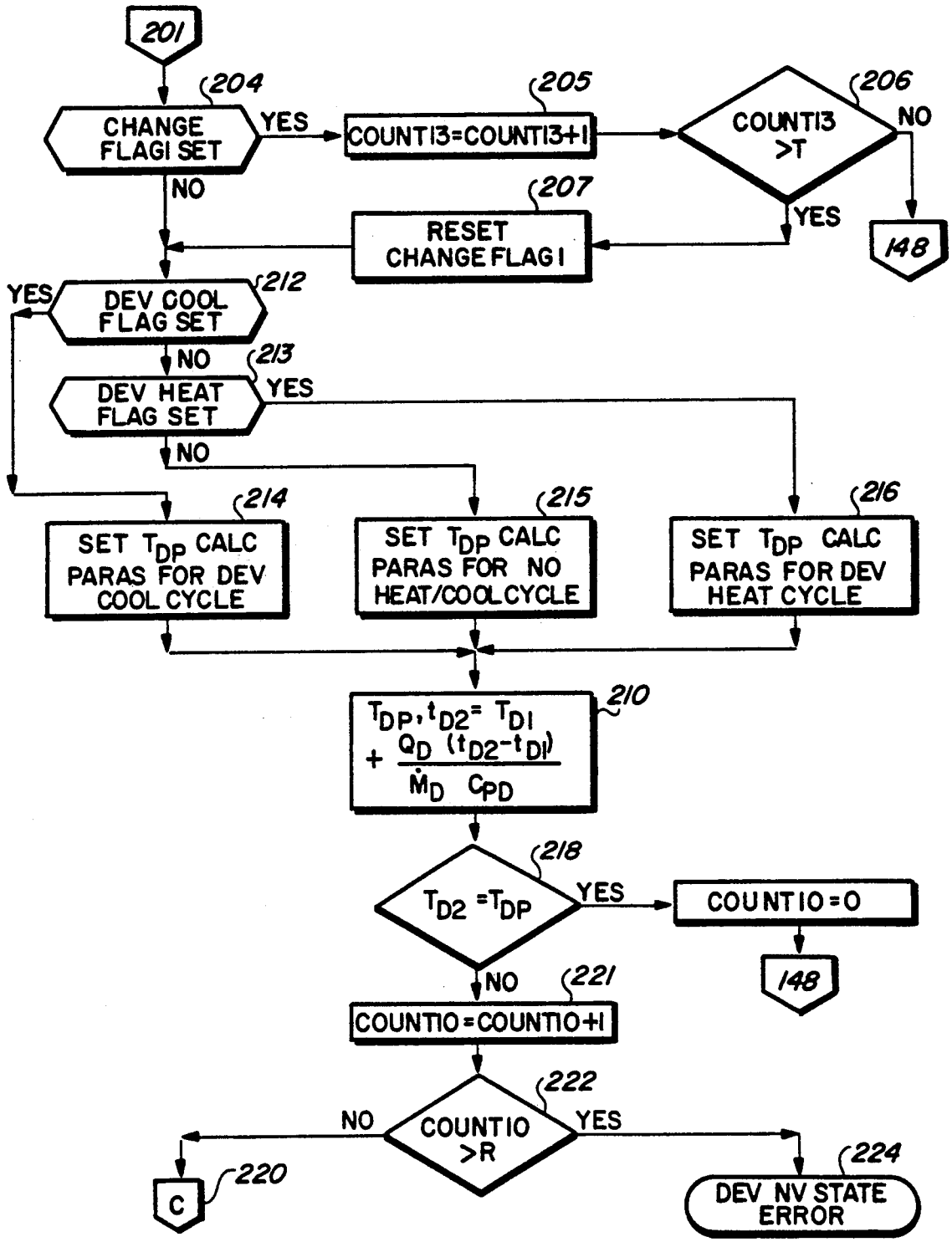
FIGS. 6–8 are other flow diagrams of the operation of the system of FIG. 4.

The steps for exemplary implementation of a developer temperature validating process in the procedure of FIG. 5 are shown in FIG. 6. The actual temperature $T_{DA}$ of developer at time $t_D$ is read, as before (116). The values of $T_{D2}$, $t_{D2}$ are then set to $T_{DA}$, $t_D$ (200), and an actual change rate $R_{DA}$ is calculated (201). However, before the measured actual temperature $T_{DA}$ or rate $R_{DA}$ used in control or error determination comparisons (148, 145, 118, 127, 139, 140), a data validating procedure is undertaken, as shown in FIG. 6. A suitable place for this to occur is between the steps 201 and 148 of FIG. 5.

The verification process may be implemented so that it takes place only after a preset time (determined by count 13 =T minutes) has elapsed since start-up or mode change (202–203, FIG. 5, and 204–207, FIG. 6). A predicted temperature $T_{DP}$ at time $t_D=t_{D2}$ is determined (210) based on an applicable heat gain (loss) factor $Q_D$ chosen in accordance with whether a heating cycle, cooling cycle or neither is active (212–216). The measured actual temperature $T_{DA}=T_{D2}$ at time $t_{D2}$ is then compared with the determined predicted temperature $T_{DP}$ at the same time $t_{D2}$ (218). If the measured actual temperature $T_{D2}$ is within acceptable tolerance $\pm Z°$ of the predicted temperature $T_{DP}$, its validity is affirmed, and that data is utilized in the control and error diagnosis comparisons (148, 145, 118, 127, 139, 140). However, if the measured temperature $T_{D2}$ is outside the acceptable tolerance $\pm Z°$, control and error diagnosis comparisons are circumvented until a valid $T_{DA}$ is encountered (218, 220).

If values of measured actual temperature $T_{DA}$ continue to deviate beyond acceptable limits from predicted values, indicating that the error is not random (i.e. occurs more than R times in a row) (221–222), an error is signalled (224) to show that non-valid temperature states are being continuously indicated.

The effect of implementation of an invalid data detection and elimination procedure in the developer temperature control process, as described, is to provide a guardband 95 (shown in dot-dashed lines in FIG. 9) about the plot of developer temperature vs. time. Any isolated data point occurring outside of the guardband 95 will be disregarded for temperature control and error diagnosis purposes.

Fixer Temperature Control

The replenishment and temperature control cycles associated with the fixer tank 22 are similar to those associated with the developer tank 21. Tank 22 is both filled and replenished automatically from a connection 57 to a supply of fresh fixer solution. Like the developer, when tank 22 is full, fixer is recirculated continuously by a recirculation pump 41 through a thermowell 43 where a thermistor 45 monitors the temperature of the solution.

When the fixer solution is circulating in path 40, a heater 44 in the thermowell 43 maintains the temperature of the solution to increase its effectiveness. This is especially important to support the faster processing modes. The duty cycle of the fixer heater 44 is not regulated like that of the developer heater 34. The fixer temperature $T_{FA}$ is determined by performing an analog-to-digital (A/D) conversion on the resistance of the thermistor 45 using the same multiplexer circuitry 86, A/D converter 87, and internal A/D converter 88 as for the developer (150). This data is then converted to a temperature in ° F. or ° C. by microprocessor 60 by means of a software algorithm. The temperature is then compared to the setpoint $T_{FS}$ stored in memory 62 to determine if heating is required (152). FIG. 10 illustrates the heating of fixer to a setpoint temperature $T_{FS}$ of about 90° F. (32.2° C.) on a plot having the same interval markings as FIG. 9, except that the origin on the temperature axis is displaced downward by 7 intervals.

The fixer, which operates more effectively at higher temperatures, does not have to be cooled. The fixer heater 45 operates at full capacity when the fixer is below the setpoint $T_{FS}$ (152, 154). When the temperature $T_{FA}$ is above the setpoint, the heater is turned off (155). Like the developer, the fixer solution should stabilize at the setpoint temperature $T_{FS}$ within 15–20 minutes after start-up, and within 5 minutes after a mode change.

The rate at which the fixer solution is heated is checked (156). If the rate of change $R_{FA}$ for the fixer temperature $T_{FA}$ is not within normal anticipations, the processor 12 will display a "loss of fixer heating ability" error message (158). The minimum acceptable heating rate for the depicted embodiment is an increase of 2.0° every 2 minutes. This error is cleared when either the rate corrects itself or, unless the film feed inhibit function is active, the fixer setpoint temperature $T_{FS}$ is reached. The fixer heat rate error is checked when the fixer is on full; the temperature is above 84° F. (29° C.) or ten minute timeout occurs; and the replenish pumps are off.

If the thermistor 45 is opened or shorted, or the temperature control A/D is not working, an "unable to determine fixer temperature" error will be displayed (160, 161). An "overtemperature" error will occur if the fixer temperature $F_{FA}$ exceeds a preestablished maximum allowable upper limit $T_{FUL}$ (163, 164). These errors are normally not cleared unless the processor 12 is deenergized and then energized again.

Figure 7:
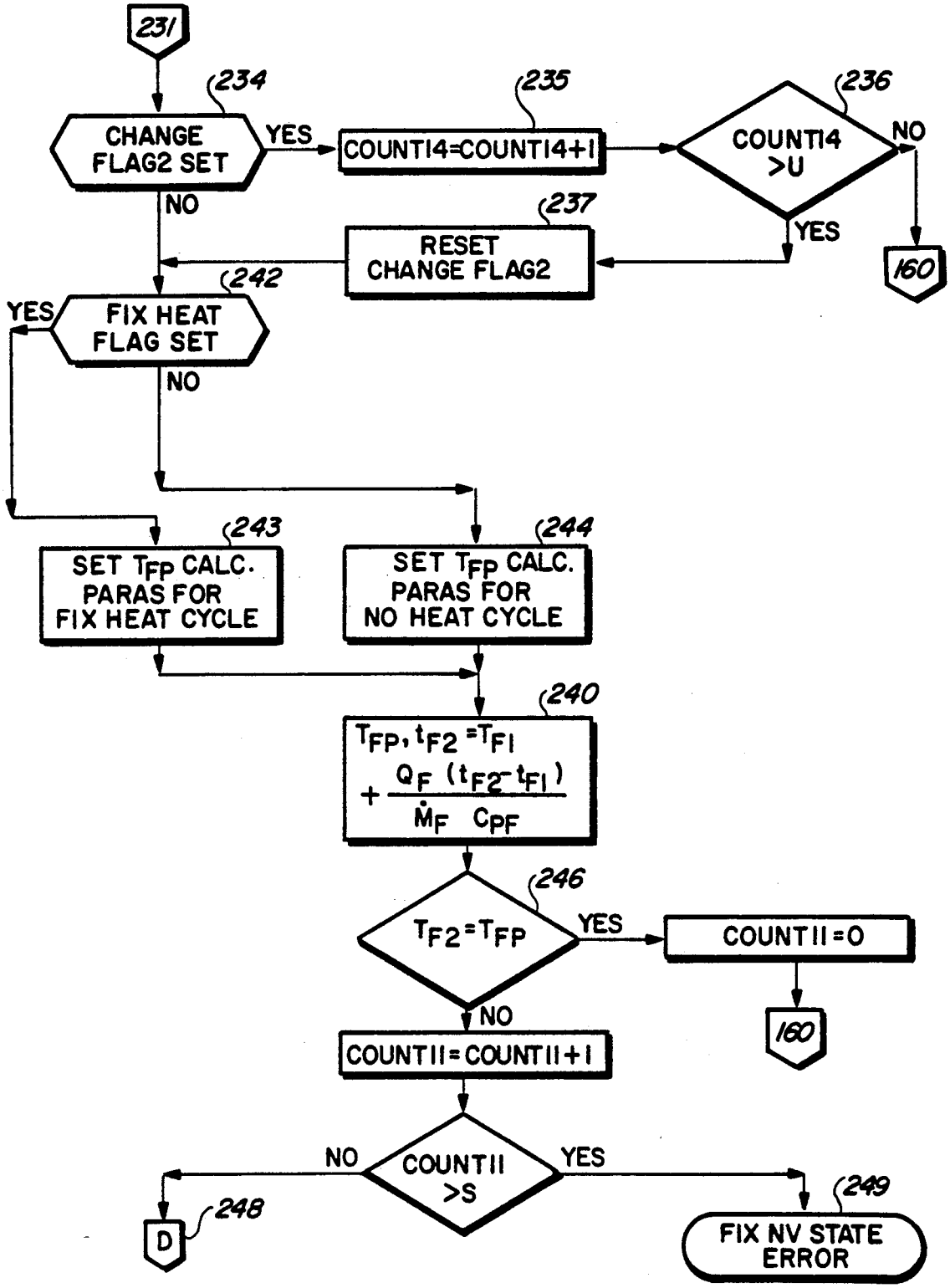

In accordance with the invention, the fixer temperature control process shown in FIG. 5 can be augmented, as shown in FIG. 7, to provide for invalid data detection and disregard. The augmentation is similar to that utilized in connection with the developer temperature control process, described above in reference to FIG. 6. The actual temperature $T_{FA}$ of fixer at time $t_F$ is read, as before (150). The values of $T_{F2}$, $t_{F2}$ are then set to $T_{FA}$, $t_F$ (230), and an actual change rate $R_{FA}$ is calculated (231). However, before the measured actual temperature $T_{FA}$ or rate $R_{FA}$ are used in control or error determination comparisons (160, 163, 152, 156), a data validating procedure is undertaken, as shown in FIG. 7, between the steps 231 and 160 of FIG. 5.

As with the developer temperature data validity verification process, the fixer temperature validity verification may be implemented so that it only takes place after a preset time (determined by count 14=U minutes) has elapsed since start-up or mode change (202-203, FIG. 5, and 234-237, FIG. 7). A predicted temperature $T_{FP}$ at time $t_F=t_{F2}$ is determined (24) based on an applicable heat gain factor $Q_F$ chosen in accordance with whether a heating cycle is active, or not (242-244). The measured actual temperature $T_{FA}=T_{F2}$ at time $t_{F2}$ is then compared with the determined predicted temperature $T_{FP}$ at the same time $t_{F2}$ (246).

If the measured actual temperature $T_{F2}$ is within acceptable tolerance of the predicted temperature $T_{FP}$, its validity is affirmed, and that data is utilized in the control and error diagnosis comparisons (160, 163, 152, 156). However, if the measured temperature $T_{F2}$ is outside the acceptable tolerance, control and error diagnosis comparisons are circumvented until a valid $T_{FA}$ is encountered (246, 248).

If values of measured actual temperature $T_{FA}$ continue to deviate beyond acceptable limits from predicted values, an error is signalled (249) to show that non-valid fixer temperature states are being continuously indicated.

The effect of implementation of an invalid data detection and elimination procedure in the fixer temperature control process, as described, is to provide a guardband 96 (shown in dot-dashed lines in FIG. 10) about the plot of fixer temperature vs. time. Any isolated data point occurring outside of the guardband 96 will be disregarded for temperature control and error diagnosis purposes.

Dryer Air Temperature Control

As film F is transported through the dryer 24, air tubes 25 circulate hot air across the film F. The tubes 25 are located on both sides of the dryer 24 to dry both sides of the film at the same time. The dryer heater 49 heats the air to a setpoint temperature $T_{AS}$ within the range of 90°-155° F. (38°-65.5° C.) as set by the user or mode default parameters. The actual temperature $T_{AA}$ in the dryer is sensed by a thermistor 52 using the same multiplexer and A/D circuits 86, 87.

The air temperature $T_{AA}$ is determined by converting the resistance of thermistor 52 into ° F. or ° C. (167). This value is then compared to the setpoint $T_{AS}$ (169). If the temperature $T_{AA}$ is below the setpoint $T_{AS}$, the dryer blower 48 and dryer heater 49 are turned on (171, 172). The blower 48 activates first, with the heater 49 following (this prevents damage to the heater) in response to activation of the vane switch 82 by the blower air (173). The heater 49 operates at full capacity. When the temperature $T_{AA}$ is above the setpoint $T_{AS}$, the dryer heater 49 is turned off (175). The actual rate $R_{AA}$ at which the air in the dryer is heated is checked (177). For the depicted embodiment, the minimum acceptable heating rate is an increase of 0.5° every 2 minutes. If the rate is not correct, an "inoperative dryer" error is displayed (178). The heat rate error is checked when the dryer heater is operating; film is not present in the processor; and after initialization is completed at power-up. If the dryer temperature $T_{AA}$ exceeds the maximum temperature value $T_{AUL}$ of the A/D converter (approximately 167° F.), an overtemperature condition exists (179). A "dryer overtemperature" data error will be displayed and the processor will shut down after the last film exits (181). If the thermistor 52 is opened or shorted, or the temperature control A/D converter 87 is not operating correctly, an "unable to determine dryer temperature" error message is displayed (183, 184). This error normally remains unless the processor is deenergized and then energized again. If the dryer setpoint temperature $T_{AS}$ is changed to a higher value, a "dryer underset temp warning" is displayed until the new setpoint is reached (185).

Figure 8:
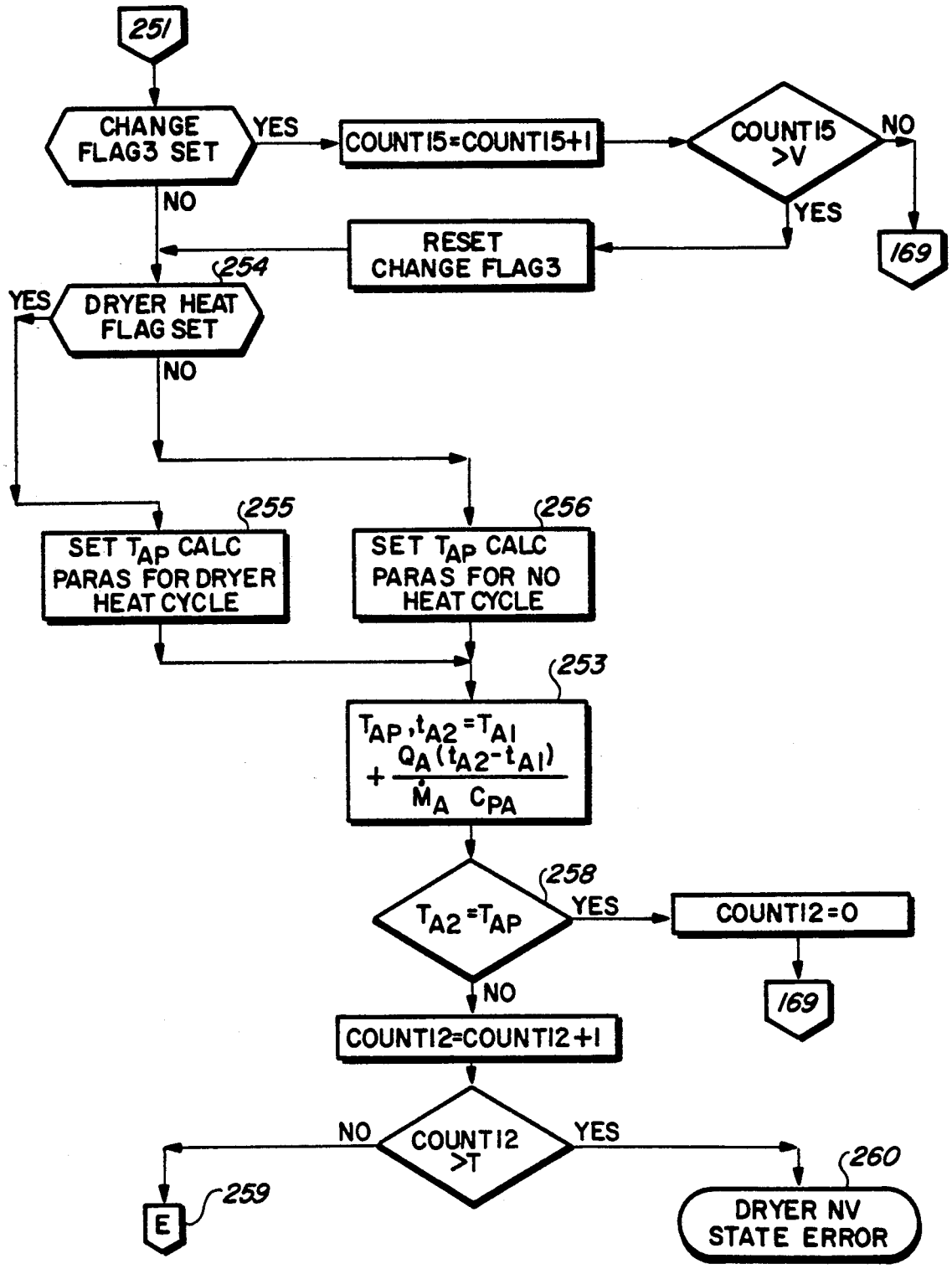

As for the developer and fixer temperature control processes, the dryer air temperature control process shown in FIG. 5 can be augmented, as shown in FIG. 8, to provide for detection and disregard of invalid data. Actual temperature $T_{AA}$ at time $t_A$ is read, as before (167). The values of $T_{A2}$, $t_{A2}$ are then set to $T_{AA}$, $t_A$ (250), and an actual change rate $R_{AA}$ is calculated (251). However, before the measured actual temperature $T_{AA}$ or rate $R_{AA}$ are used in control or error determination comparisons (169, 183, 179, 177), a data validating procedure is undertaken, as shown in FIG. 8, between the steps 251 and 169 of FIG. 5.

A predicted temperature $T_{AP}$ at time $t_A=t_{A2}$ is determined (253) based on an applicable heat gain factor $Q_A$ chosen in accordance with whether a heating cycle is active, or not (254-256). The measured actual temperature $T_{AA}=T_{A2}$ at time $t_{A2}$ is then compared with the determined predicted temperature $T_{AP}$ at the same time $t_{A2}$ (258). If the measured actual temperature $T_{A2}$ is within acceptable tolerance of the predicted temperature $T_{AP}$, its validity is affirmed, and that data is utilized in the control and error diagnosis comparisons (169, 183, 179, 177). However, if the measured temperature $T_{A2}$ is outside the acceptable tolerance, control and error diagnosis comparisons are circumvented until a valid $T_{AA}$ is encountered (258, 259). If values of the measured actual temperature $T_{AA}$ continue to be invalid, an error is signalled (260) to show that non-valid dryer air temperature states continue.

As film F leaves the dryer 28, it passes through the exit opening 19 where it is transported out of the interior of the processor 12 and into the top receiving tray 18. If no new film F enters the processor, the processor will enter a standby mode approximately 15 seconds after a film has exited. In the standby mode the water supply is turned off, unless needed for developer cooling; the developer, fixer and dryer temperatures are maintained at their setpoints $T_{DS}$, $T_{FS}$ and $T_{AS}$; and the drive motor 67 is changed to standby operation.

Those skilled in the art to which the invention relates will appreciate that other substitutions and modifications can be made to the described embodiment without departing from the spirit and scope of the invention as described by the claims below.

What is claimed is:

1. A method for controlling temperature in the processing of exposed photosensitive media utilizing apparatus having means for automatically transporting said media from a feed point along a path through developer, fixer, wash and dryer stations, a developer temperature sensor, and means for changing the temperature of said developer; said method including the steps of:

establishing a reference developer temperature $T_{DS}$;

sensing a series of actual temperatures $T_{DA}$ of developer located at said developer station at particular respective times $t_D$, using said developer temperature sensor; and regulating the temperature of said developer in accordance with said reference temperature $T_{DS}$ and in response to said sensed actual temperatures $T_{DA}$, using said developer temperature changing means;

and said method being characterized in that:

said sensing step comprises sensing an actual temperature $T_{D1}$ at a particular time $t_{D1}$, and an actual temperature $T_{D2}$ at a particular time $t_{D2}$; and said method further comprises automatically determining a predicted developer temperature $T_{DP}$ at said time $t_{D2}$ based on said sensed actual temperature $T_{D1}$ at said time $t_{D1}$, and a preestablished heat gain per unit time relationship applicable for said developer temperature changing means during the time interval $t_{D2}-t_{D1}$;

automatically comparing said sensed actual temperature $T_{D2}$ with said determined predicted temperature $T_{DP}$; and disregarding said temperature $T_{D2}$ in said temperature regulating step, if the value of said sensed temperature $T_{D2}$ deviates from the value of said predicted temperature $T_{DP}$ by more than a predetermined amount.

2. A method as in claim 1, wherein said method further comprises establishing a reference developer upper limit temperature $T_{DUL}$; normally signalling an above temperature error when said sensed actual temperatures $T_{DA}$ exceed said upper limit temperature $T_{DUL}$; and disregarding said sensed actual temperature $T_{D2}$ in said signalling step, if said value of said sensed temperature $T_{D2}$ deviates from said value of said predicted temperature $T_{DP}$ by more than said predetermined amount.

3. A method as in claim 1, wherein said method further comprises establishing a reference rate of change of developer temperature $R_{DS}$;

automatically determining actual rates of change of developer temperature $R_{DA}$ based on said sensed actual temperatures;

automatically comparing said actual rates of change $R_{DA}$ with said reference rate of change $R_{DS}$;

normally providing a rate error signal when said actual rates of change $R_{DA}$ deviate from said reference rate of change $R_{DS}$ by more than a preestablished amount; and disregarding said sensed actual temperature $T_{D2}$ in said rate error signal providing step, if said value of said sensed temperature $T_{D2}$ deviates from said value of said predicted temperature $T_{DP}$ by more than said predetermined amount.

4. A method as in claim wherein said apparatus further comprises a fixer temperature sensor and means for changing the temperature of said fixer; and wherein said method further comprises the steps of:

establishing a reference fixer temperature $T_{FS}$;

sensing a series of actual temperatures $T_{FA}$ of fixer located at said fixer station at particular respective times $t_F$, using said fixer temperature sensor; said fixer temperature sensing step comprising sensing an actual temperature $T_{F1}$ at a particular time $t_{F1}$, and an actual temperature $T_{F2}$ at a particular time $t_{F2}$; and regulating the temperature of said fixer in accordance with said reference temperature $T_{FS}$ and in response to said sensed actual temperatures $T_{FA}$, using said fixer temperature changing means; and said method further comprising automatically determining a predicted fixer temperature $T_{FP}$ at said time $t_{F2}$ based on said sensed actual temperature $T_{F1}$ at said time $t_{F1}$, and a preestablished heat gain per unit time relationship applicable for said fixer temperature changing means during the time interval $t_{F2}-t_{F1}$;

automatically comparing said sensed actual temperature $T_{F2}$ with said determined predicted temperature $T_{FP}$; and disregarding said temperature $T_{F2}$ in said fixer temperature regulating step, if the value of said sensed temperature $T_{F2}$ deviates from the value of said predicted temperature $T_{FP}$ by more than a predetermined fixer temperature tolerance amount.

5. A method as in claim 4, wherein said method further comprises establishing a reference fixer upper limit temperature $T_{FUL}$; normally signalling a fixer above temperature error when said sensed actual fixer temperatures $T_{FA}$ exceed said fixer upper limit temperature $T_{FUL}$; and disregarding said sensed actual fixer temperature $T_{F2}$ in said fixer above temperature error signalling step, if said value of said sensed fixer temperature $T_{F2}$ deviates from said value of said predicted fixer temperature $T_{FP}$ by more than said predetermined fixer temperature tolerance amount.

6. A method as in claim 4, wherein said method further comprises establishing a reference rate of change of fixer temperature $R_{FS}$;

automatically determining actual rates of change of fixer temperature $R_{FA}$ based on said sensed actual fixer temperatures;

automatically comparing said actual rates of fixer temperature change $R_{FA}$ with said reference rate of fixer temperature change $R_{FS}$;

normally providing a fixer temperature rate error signal when said actual rates of fixer temperature change $R_{FA}$ deviate from said reference rate of fixer temperature change $R_{FS}$ by more than a preestablished fixer temperature rate of change tolerance amount; and disregarding said sensed actual fixer temperature $T_{F2}$ in said fixer rate error signal providing step, if said value of said sensed fixer temperature $T_{F2}$ deviates from said value of said predicted fixer temperature $T_{FP}$ by more than said predetermined fixer temperature tolerance amount.

7. A method as in claim 4, wherein said apparatus further comprises a dryer air temperature sensor and means for changing the temperature of said dryer air; and wherein said method further comprises the steps of:

establishing a reference dryer air temperature $T_{AS}$;

sensing a series of actual temperatures $T_{AA}$ of air located at said dryer station respectively at particular times $t_A$, using said dryer air temperature sensor; said dryer air temperature sensing step comprising sensing an actual dryer air temperature $T_{A1}$ at a particular time $t_{A1}$, and an actual dryer air temperature $T_{A2}$ at a particular time $t_{A2}$; and regulating the temperature of said dryer air in accordance with said reference temperature $T_{AS}$ and in response to said sensed actual dryer air temperatures $T_{AA}$, using said dryer air temperature changing means; and said method further comprising automatically determining a predicted dryer air temperature $T_{AP}$ at said time $t_{A2}$ based on said sensed actual dryer air temperature $T_{A1}$ at said time $t_{A1}$, and a preestablished heat gain per unit time relationship applicable for said dryer air temperature changing means during the time interval $t_{A2}-t_{A1}$;

automatically comparing said sensed actual dryer air temperature $T_{A2}$ with said determined predicted dryer air temperature $T_{AP}$; and disregarding said temperature $T_{A2}$ in said dryer air temperature regulating step, if the value of said sensed temperature $T_{A2}$ deviates from the value of said predicted temperature $T_{AP}$ by more than a predetermined dryer air temperature tolerance amount.

8. A method as in claim 7, wherein said method further comprises establishing a reference dryer air upper limit temperature $T_{AUL}$; normally signalling a dryer air above temperature error when said sensed actual dryer air temperatures $T_{AA}$ exceed said dryer air upper limit temperature $T_{AUL}$; and disregarding said sensed actual dryer air temperature $T_{A2}$ in said dryer air above temperature error signalling step, if said value of said sensed dryer air temperature $T_{A2}$ deviates from said value of said predicted dryer air temperature $T_{AP}$ by more than said predetermined dryer air temperature tolerance amount.

9. A method as in claim 7, wherein said method further comprises establishing a reference rate of change of dryer air temperature $R_{AS}$;

automatically determining actual rates of change of dryer air temperature $R_{AA}$ based on said sensed actual dryer air temperatures;

automatically comparing said actual rates of dryer air temperature change $R_{AA}$ with said reference rate of dryer temperature change $R_{AS}$;

providing a dryer air temperature rate error signal when said actual rates of dryer air temperature change $R_{AA}$ deviate from said reference rate of dryer air temperature change $R_{AS}$ by more than a preestablished dryer air temperature rate of change tolerance amount; and disregarding said sensed actual dryer air temperature $T_{A2}$ in said dryer air rate error signal providing step, if said value of said sensed dryer air temperature $T_{A2}$ deviates from said value of said predicted dryer air temperature $T_{AP}$ by more than said predetermined dryer air temperature tolerance amount.

10. A method for controlling temperature in the processing of exposed photosensitive media utilizing apparatus having means for automatically transporting said media from a feed point along a path through developer, fixer, wash and dryer stations, a fixer temperature sensor, and means for changing the temperature of said fixer; said method including the steps of:

establishing a reference fixer temperature $T_{FS}$;

sensing a series of actual temperatures $T_{FA}$ of fixer located at said fixer station at particular respective times $t_F$, using said fixer temperature sensor; and regulating the temperature of said fixer in accordance with said reference temperature $T_{FS}$ and in response to said sensed actual temperatures $T_{FA}$, using said fixer temperature changing means;

and said method being characterized in that:

said sensing step comprises sensing an actual temperature $T_{F1}$ at a particular time $t_{F1}$, and an actual temperature $T_{F2}$ at a particular time $t_{F2}$; and said method further comprises automatically determining a predicted fixer temperature $T_{FP}$ at said time $t_{F2}$ based on said sensed actual temperature $T_{F1}$ at said time $t_{F1}$, and a preestablished heat gain per unit time relationship applicable for said fixer temperature changing means during the time interval $t_{F2}-t_{F1}$;

automatically comparing said sensed actual temperature $T_{F2}$ with said determined predicted temperature $T_{FP}$; and disregarding said temperature $T_{F2}$ in said temperature regulating step, if the value of said sensed temperature $T_{F2}$ deviates from the value of said predicted temperature $T_{FP}$ by more than a predetermined amount.

11. A method as in claim 10, wherein said method further comprises establishing a reference fixer upper limit temperature $T_{FUL}$; normally signalling an above temperature error when said sensed actual temperatures $T_{FA}$ exceed said upper limit temperature $T_{FUL}$; and disregarding said sensed actual temperature $T_{F2}$ in said signalling step, if said value of said sensed temperature $T_{F2}$ deviates from said value of said predicted temperature $T_{FP}$ by more than said predetermined amount.

12. A method as in claim 10, wherein said method further comprises establishing a reference rate of change of fixer temperature $R_{FS}$;

automatically determining actual rates of change of fixer temperature $R_{FA}$ based on said sensed actual temperatures;

automatically comparing said actual rates of change $R_{FA}$ with said reference rate of change $R_{FS}$;

normally providing a rate error signal when said actual rates of change $R_{FA}$ deviate from said reference rate of change $R_{FS}$ by more than a preestablished amount; and disregarding said sensed actual temperature $T_{F2}$ in said rate error signal providing step, if said value of said sensed temperature $T_{F2}$ deviates from said value of said predicted temperature $T_{FP}$ by more than said predetermined amount.

13. A method for controlling temperature in the processing of exposed photosensitive media utilizing apparatus having means for automatically transporting said media from a feed point along a path through developer, fixer, wash and dryer stations, a dryer air temperature sensor, and means for changing the temperature of said dryer air; said method including the steps of:

establishing a reference dryer air temperature $T_{AS}$;

sensing a series of actual temperatures $T_{AA}$ of dryer air located at said dryer station at particular respective times $t_A$, using said dryer air temperature sensor; and regulating the temperature of said dryer air in accordance with said reference temperature $T_{AS}$ and in response to said sensed actual temperatures $T_{AA}$, using said dryer air temperature changing means;

and said method being characterized in that:

said sensing step comprises sensing an actual temperature $T_{A1}$ at a particular time $t_{A1}$, and an actual temperature $T_{A2}$ at a particular time $t_{A2}$; and said method further comprises automatically determining a predicted dryer air temperature $T_{AP}$ at said time $t_{A2}$ based on said sensed actual temperature $T_{A1}$ at said time $t_{A1}$, and a preestablished heat gain per unit time relationship applicable for said dryer air temperature changing means during the time interval $t_{A2}-t_{A1}$;

automatically comparing said sensed actual temperature $T_{A2}$ with said determined predicted temperature $T_{AP}$; and disregarding said temperature $T_{A2}$ in said temperature regulating step, if the value of said sensed temperature $T_{A2}$ deviates from the value of said predicted temperature $T_{AP}$ by more than a predetermined amount.

14. A method as in claim 13, wherein said method further comprises establishing a reference dryer air upper limit temperature $T_{AUL}$; normally signalling an above temperature error when said sensed actual temperatures $T_{AA}$ exceed said upper limit temperature $T_{AUL}$; and disregarding said sensed actual temperature $T_{A2}$ in said signalling step, if said value of said sensed temperature $T_{A2}$ deviates from said value of said predicted temperature $T_{AP}$ by more than said predetermined amount.

15. A method as in claim 13, wherein said method further comprises establishing a reference rate of change of dryer air temperature $R_{AS}$;

automatically determining actual rates of change of dryer air temperature $R_{AA}$ based on said sensed actual temperatures;

automatically comparing said actual rates of change $R_{AA}$ with said reference rate of change $R_{AS}$;

normally providing a rate error signal when said actual rates of change $R_{AA}$ deviate from said reference rate of change $R_{AS}$ by more than a preestablished amount; and disregarding said sensed actual temperature $T_{A2}$ in said rate error signal providing step, if said value of said sensed temperature $T_{A2}$ deviates from said value of said predicted temperature $T_{AP}$ by more than said predetermined amount.

* * * * *

UNITED STATES PATENT AND TRADEMARK OFFICE

CERTIFICATE OF CORRECTION

PATENT NO. : 5,245,377

DATED : September 14, 1993

INVENTOR(S) : James Samuels, et al

It is certified that error appears in the above-indentified patent and that said Letters Patent is hereby corrected as shown below:

Column 11, line 43, after "$R_{DA}$", insert --are--.

Column 15, line 67, after "claim", insert --1--.

Signed and Sealed this

Twenty-ninth Day of March, 1994

Bruce Lehman

*Attest:*

BRUCE LEHMAN

*Attesting Officer*

*Commissioner of Patents and Trademarks*